US011243493B2

(12) United States Patent
Ando

(10) Patent No.: US 11,243,493 B2
(45) Date of Patent: Feb. 8, 2022

(54) IMAGE FORMING APPARATUS INCLUDING A WASTE TONER CONTAINER REMOVABLY INSTALLED

(71) Applicant: KYOCERA Document Solutions Inc., Osaka (JP)

(72) Inventor: Satoshi Ando, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/325,585

(22) Filed: May 20, 2021

(65) Prior Publication Data

US 2021/0364976 A1 Nov. 25, 2021

(30) Foreign Application Priority Data

May 25, 2020 (JP) ..... JP2020-090819

(51) Int. Cl.
*G03G 21/12* (2006.01)
*G03G 21/16* (2006.01)

(52) U.S. Cl.
CPC ..... *G03G 21/12* (2013.01); *G03G 21/1633* (2013.01)

(58) Field of Classification Search
CPC ..... G03G 21/12; G03G 21/1633
See application file for complete search history.

(56) References Cited

U.S. PATENT DOCUMENTS 8,634,743 B2 * 1/2014 Akaike ..... G03G 21/1633 399/110
8,843,030 B2 * 9/2014 Ishikake ..... G03G 21/12 399/120
9,020,368 B2 * 4/2015 Uohashi ..... H01H 13/02 399/9
9,229,420 B2 * 1/2016 Akiyama ..... E05D 3/12
9,316,998 B2 * 4/2016 Imanaka ..... G03G 21/12
2015/0338811 A1 * 11/2015 Okura ..... G03G 21/12 399/35

FOREIGN PATENT DOCUMENTS

JP 2014-215370 11/2014

* cited by examiner

*Primary Examiner* — Walter L Lindsay Jr.
*Assistant Examiner* — Milton Gonzalez
(74) *Attorney, Agent, or Firm* — Lex IP Meister, PLLC

(57) ABSTRACT

An image forming apparatus includes a waste toner container installed removably in an apparatus body through an opening and collecting a waste toner discharged from an image forming section in which an image is formed with toner, and an opening/closing cover supported at an edge of the opening and pivoting about an axis line extending in a specific direction, the opening/closing cover pivoting about the axis line and moving between a closed position to close the opening and an open position to open the opening. The waste toner container has an engaged part, and the opening/closing cover has an engaging part that engages with the engaged part. The engaging part engages with the engaged part in the closed position to hold the opening/closing cover in the closed position when the waste toner container is installed in the apparatus body.

6 Claims, 11 Drawing Sheets

IMAGE FORMING APPARATUS INCLUDING A WASTE TONER CONTAINER REMOVABLY INSTALLED

INCORPORATION BY REFERENCE

This application is based upon, and claims the benefit of priority from, corresponding Japanese Patent Application No. 2020-090819 filed in the Japan Patent Office on May 25, 2020, the entire contents of which are incorporated herein by reference.

BACKGROUND

Field of the Invention

The present disclosure relates to an image forming apparatus.

Description of Related Art

A typical image forming apparatus that has been known includes a waste toner container removably installed in an apparatus body through an opening and collects waste toner discharged from the image forming section in which images are formed with toner. The waste toner container is installed and removed through the opening formed in the side of the body of the image forming apparatus. An opening/closing cover that pivots about an axis line extending in the vertical direction is attached to an edge of the opening. The opening/closing cover is movable between a closed position to close the opening and an open position to open the opening. By opening the opening/closing cover, the user can access and replace the waste toner container installed in the apparatus body. The opening/closing cover has a hook which is locked to a locking part on the apparatus body when the opening/closing cover is moved to the closed position.

A known image forming apparatus of this kind includes a detection sensor that detects the waste toner container installed in the apparatus body. When the detection sensor does not detect the waste toner container, an error message appears on a display of an operation panel of the image forming apparatus.

SUMMARY

An image forming apparatus according to the present disclosure includes a waste toner container installed removably in an apparatus body through an opening and collecting a waste toner discharged from an image forming section in which an image is formed with toner, and an opening/closing cover supported at an edge of the opening and pivoting about an axis line extending in a specific direction, the opening/closing cover pivoting about the axis line and moving between a closed position to close the opening and an open position to open the opening.

The waste toner container has an engaged part, the opening/closing cover has an engaging part that engages with the engaged part, and the engaging part engages with the engaged part in the closed position to hold the opening/closing cover in the closed position when the waste toner container is installed in the apparatus body.

DETAILED DESCRIPTION

Hereinafter, an embodiment of the present disclosure will be described in detail with reference to the accompanying drawings. It is noted that the present disclosure is not limited to the following embodiment.

Embodiment

Overall Structure

Figure 1:
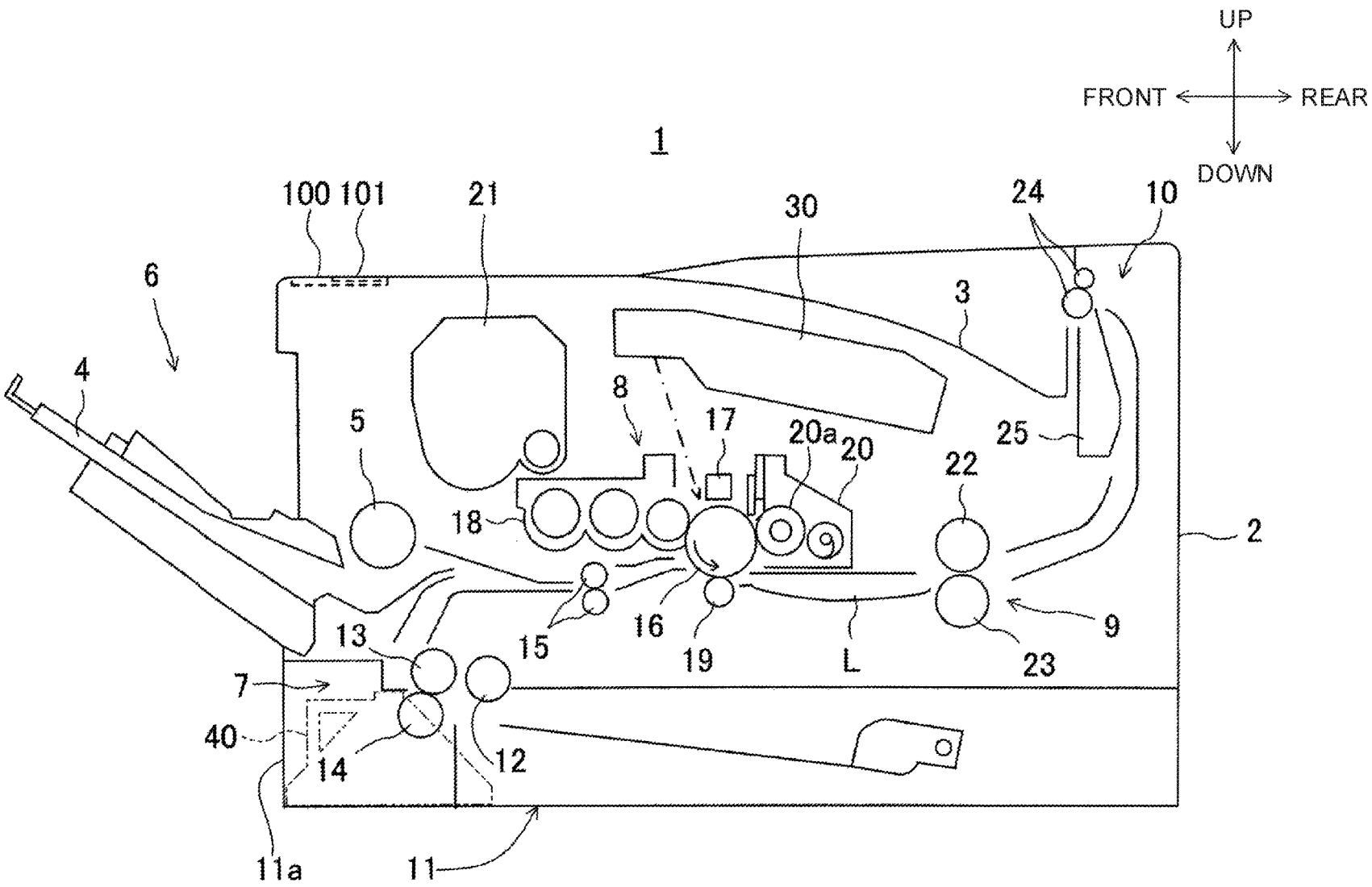
FIG. 1 is a schematic view showing an internal structure of an image forming apparatus according to an embodiment.

FIG. 1 is a schematic view showing an image forming apparatus 1 of the present embodiment. In the following description, unless otherwise specified, a front side and a rear side respectively refer to the front side and the rear side of the image forming apparatus 1 (corresponding to the left side and the right side of FIG. 1), and a left side and a right side respectively refer to the left side and the right side of the image forming apparatus 1 when viewed from the front side.

As shown in FIG. 1, the image forming apparatus 1 includes a box-shaped apparatus body 2, a manual sheet feed section 6, a cassette sheet feed section 7, an image forming section 8, a fixing section 9, and a sheet discharge section 10. An operation panel 100 is disposed at the front right corner of the upper surface of the apparatus body 2 to allow the user to make various settings and commands to the image forming apparatus 1. The operation panel 100 includes an operation unit (not shown) such as push buttons or a numeric keypad that can be operated with fingers of the user, and a display unit 101 that displays various information. The user can command image data printing to the image forming apparatus 1 by operating this operation unit or an external terminal linked to the image forming apparatus 1 via large area network (LAN) connection.

Upon receipt of a print command from the operation panel 100 or an external terminal, the image forming apparatus 1 forms an image on a sheet of paper in accordance with the image data, while conveying the sheet along a conveyance path L in the apparatus body 2.

The manual sheet feed section 6 includes an opening/closing manual sheet feed tray 4 disposed on one side of the apparatus body 2, and a manual sheet feed roller 5 disposed rotatably in the apparatus body 2.

The cassette sheet feed section 7 is disposed in the bottom part of the apparatus body 2. The cassette sheet feed section 7 includes a sheet feed cassette 11 that accommodates a plurality of sheets stacked on top of each other, a pick roller 12 that picks up the sheets in the sheet feed cassette 11 one by one, and a feed roller 13 and a retard roller 14 that separate the picked up sheets one by one and feed them to the conveyance path L. The sheet feed cassette 11 is formed in a flat rectangular box shape having longer sides extending in the front-rear direction and an entirely opened upper side. The sheet feed cassette 11 can be pulled out to the front side (an example of the outside) of the apparatus body 2 from an installed position (the position shown in FIG. 1) at which the sheets can be supplied to the image forming section 8. An outer decorative cover 11*a* made of resin is fixed to the front wall of the sheet feed cassette 11. The user can load sheets into the sheet feed cassette 11 by placing a finger on the bottom edge of the outer decorative cover 11*a* and drawing the sheet feed cassette 11 and the outer decorative cover 11*a* frontward.

The image forming section 8 is disposed above the cassette sheet feed section 7 in the apparatus body 2. The image forming section 8 includes a photoconductor drum 16 which is an image carrier that can rotate in the apparatus body 2. Around the photoconductor drum 16, a charger 17, a developing section 18, a transfer roller 19, and a cleaning section 20 are arranged in this order in a counterclockwise direction with respect to the twelve o'clock position. An optical scanner 30 and a toner container 21 are disposed above the photoconductor drum 16. The image forming section 8 forms an image on the sheet supplied from the manual sheet feed section 6 or the cassette sheet feed section 7. A pair of resist rollers 15 are disposed in the conveyance path L to temporarily suspend the fed sheet and then feed it to the image forming section 8 at specific timing.

The fixing section 9 is located at the side of the image forming section 8. The fixing section 9 includes a fixing roller 22 and a pressing roller 23 that rotate while pressing against each other. The fixing section 9 fixes the toner image that has been transferred onto the sheet in the image forming section 8 on the sheet.

The sheet discharge section 10 is disposed above the fixing section 9. The sheet discharge section 10 includes a sheet discharge tray 3, a pair of sheet discharge rollers 24 that conveys the sheet to the sheet discharge tray 3, and a plurality of transport guide ribs 25 that guides the sheet to the pair of sheet discharge rollers 24. The sheet discharge tray 3 is formed in a concave shape on the upper side of the apparatus body 2.

When the image forming apparatus 1 receives image data, the photoconductor drum 16 is driven to rotate and charged by the charger 17 in the image forming section 8. The optical scanner 30 emits laser beam to the photoconductor drum 16 in accordance with the image data. The laser beam illuminates the surface of the photoconductor drum 16 to form an electrostatic latent image. The electrostatic latent image formed on the surface of the photoconductor drum 16 is developed in the developing section 18 and made visible as a toner image. After development, a residual toner left on the photoconductor drum 16 is removed by a sliding roller 20*a* and collected in a cleaning case in the cleaning section 20. The collected toner is conveyed as waste toner to a waste toner container 40 through a toner conveyance pipe (not shown).

On the other hand, the toner image formed on the surface of the photoconductor drum 16 is transferred toward the transfer roller 19 using the transfer bias of a polarity opposite to that of the toner applied to the transfer roller 19, and is transferred to the sheet while the sheet passes through a nip between the transfer roller 19 and the photoconductor drum 16. The sheet on which the toner image is transferred is heated and pressed by the fixing roller 22 and the pressing roller 23 in the fixing section 9. Thus, the toner image is fixed on the sheet.

Container Structure for Waste Toner Container

Figure 2:
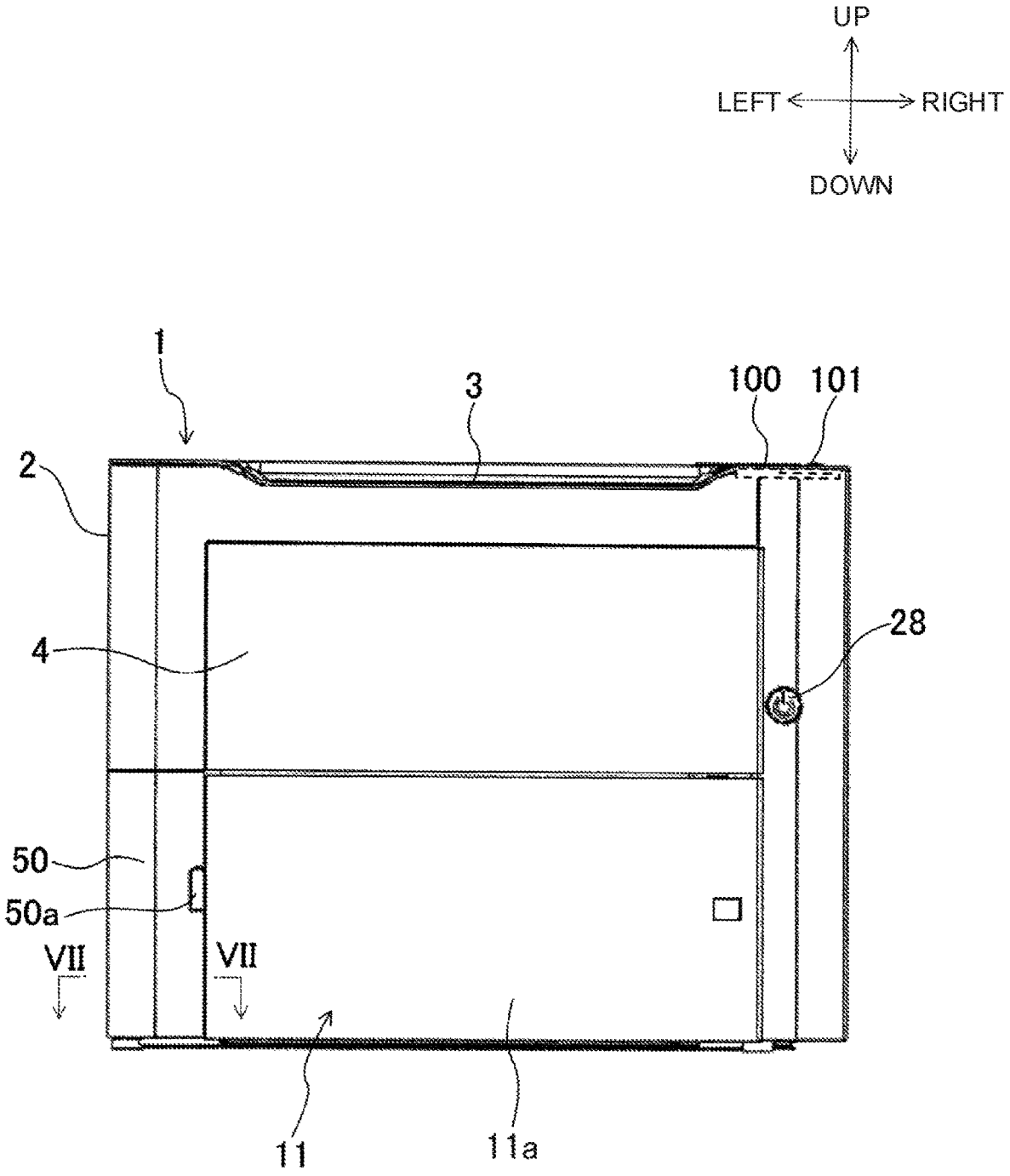
FIG. 2 is a front view of the image forming apparatus showing an opening/closing cover in a closed position when viewed from the front side.
Figure 3:
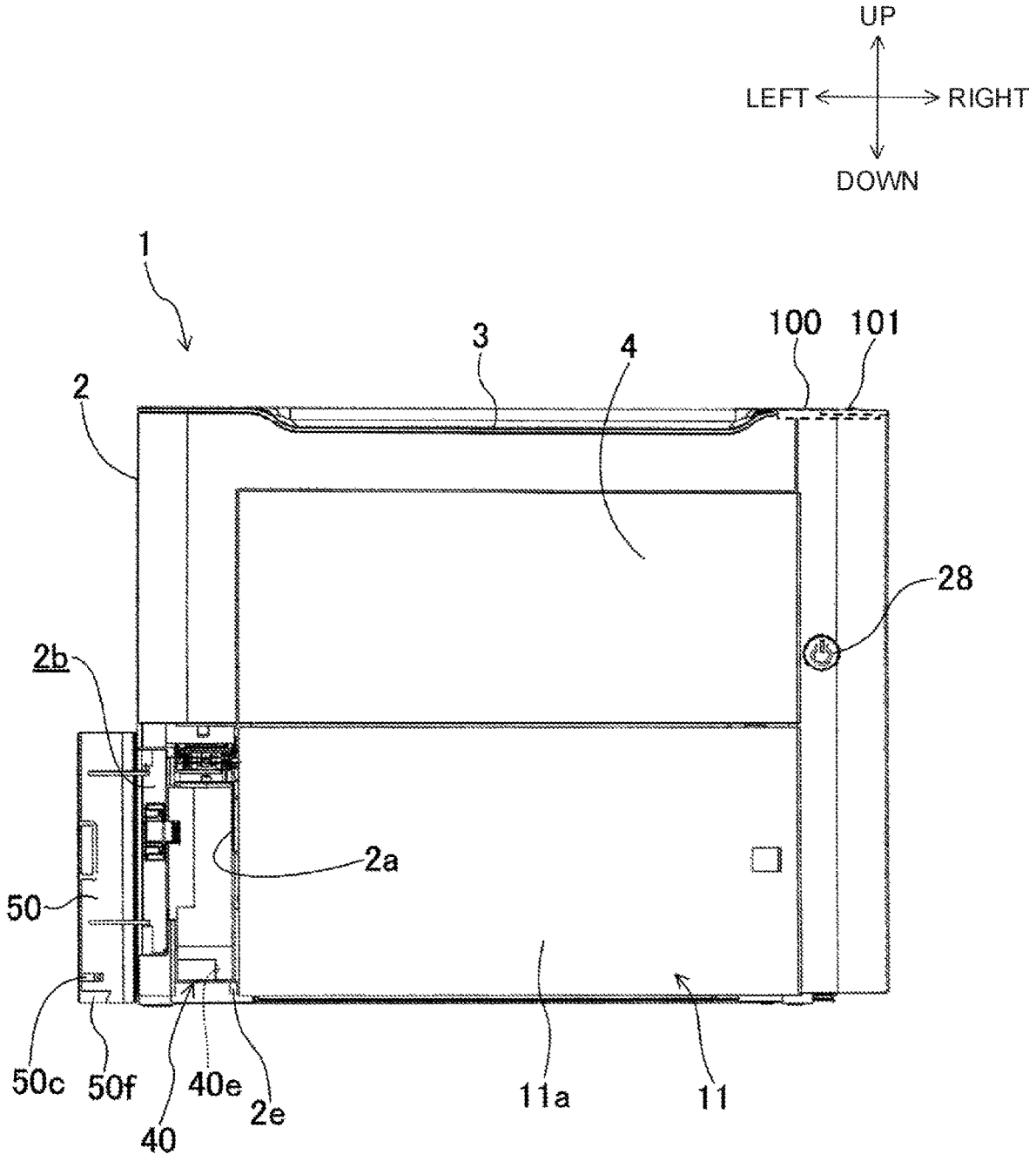
FIG. 3 is a front view of the image forming apparatus showing the opening/closing cover in an open position when viewed from the front side.

The waste toner container 40 is disposed in the lower left part of the front side (the left side of the manual sheet feed tray 4) of the apparatus body 2. As shown in FIGS. 2 and 3, an opening 2*a* (see FIG. 3) having a rectangular shape and longer sides in the vertical direction when viewed from the front side is formed in the lower left part of the front side of the apparatus body 2. The opening 2*a* can be opened and closed by an opening/closing cover 50. On the rear side (inside) of the opening/closing cover 50 in the apparatus body 2, an installation space 2*b* (see FIG. 3), which will be described later, is formed to accommodate the waste toner container 40. A power switch 28 of the image forming apparatus 1 is disposed as shown in FIGS. 2 and 3.

A detection sensor (not shown) is disposed to detect the waste toner container 40 in the installation space 2*b*. The detection sensor is connected to a controller disposed in the apparatus body 2. The controller is constituted by a microcomputer including a central processing unit (CPU), a read-only memory (ROM), and a random access memory (RAM), and controls the operation of each part of the image forming apparatus 1. The controller causes the display unit 101 of the operation panel 100 to display an error message indicating that the waste toner container 40 is not installed if the controller receives a print start command from the operation panel 100 or an external terminal without receiving the detection signal of the waste toner container 40 from the detection sensor.

Structure of Waste Toner Container

Figure 4:
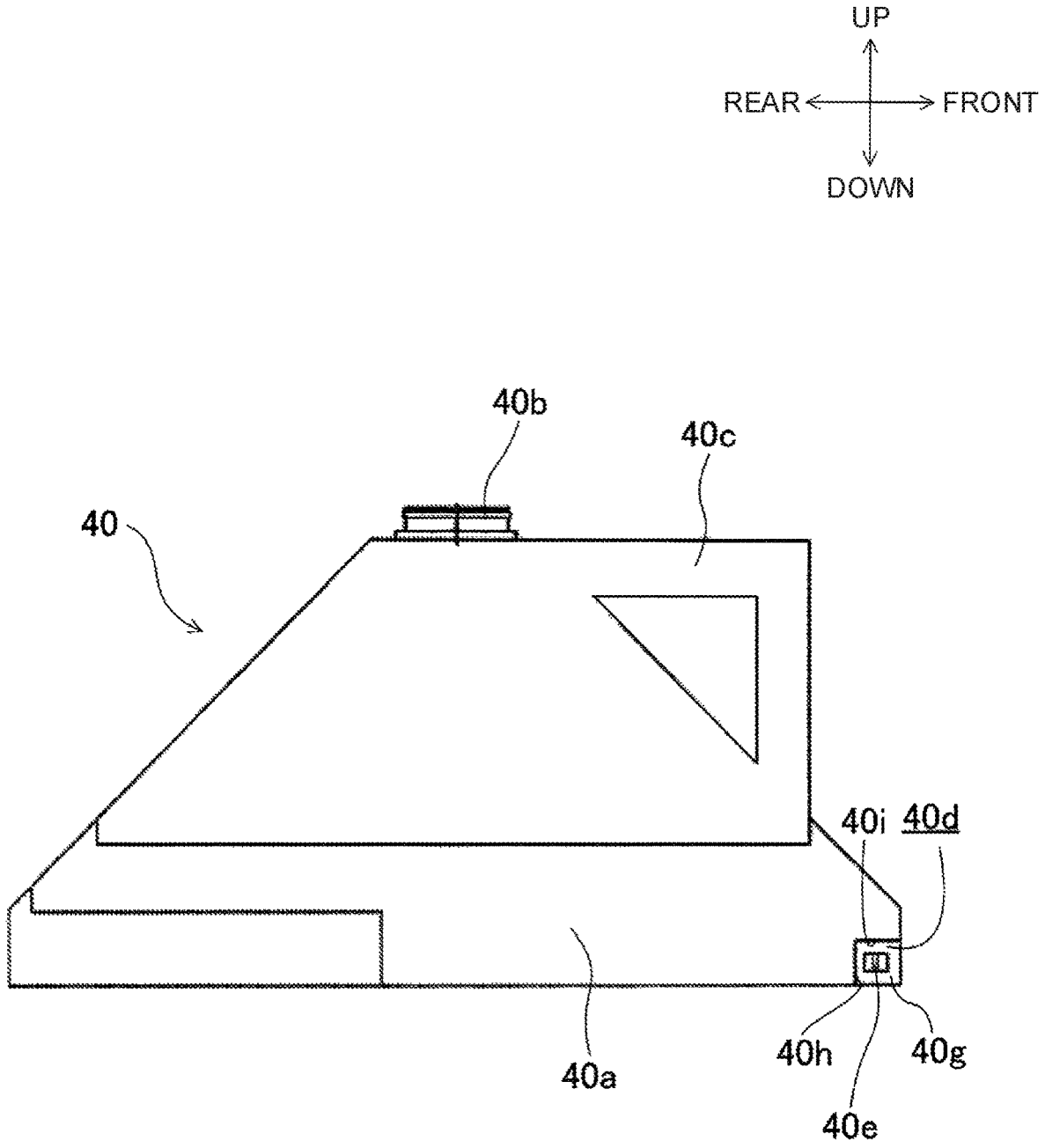
FIG. 4 is a side view showing a waste toner container.

As shown in FIG. 4, the waste toner container 40 is a hollow container flat in the thickness direction (perpendicular to the sheet surface of FIG. 4), and is made of, for example, plastic or the like. The waste toner container 40 is removably installed in the installation space 2*b* (see FIG. 3) with its thickness direction coinciding with the left-right direction of the image forming apparatus 1. In the following description of the waste toner container 40, front, rear, left, and right respectively refer to the front, rear, left and right sides of the waste toner container 40 in the installed state.

As shown in FIG. 4, the waste toner container 40 includes a container body 40*a*, a toner inlet pipe 40*b*, and a handle 40*c*. The container body 40*a* is formed in a trapezoidal shape (see FIG. 4) with a wider width on the lower side when viewed in the left-right direction, and is formed in a vertically long and substantially rectangular shape (see FIG. 3) when viewed from the front side.

The toner inlet pipe 40*b* is integrally formed on the upper surface of the container body 40*a*. The toner inlet pipe 40*b* protrudes upward in a cylindrical shape from the upper surface of the container body 40*a*. A disc-shaped cap 40*f* (shown only in FIGS. 8 and 9 which will be described later) is connected to the upper end of the toner inlet pipe 40*b* via a flexible piece that can be bent. The cap 40*f* engages/disengages with/from the upper edge of the toner inlet pipe

40*b* to open and close the upper end of the opening of the toner inlet pipe 40*b*. The waste toner container 40 is accommodated in the installation space 2*b* by removing the cap 40*f* from the upper end of the toner inlet pipe 40*b* and connecting a toner conveyance pipe (not shown) to the upper end of the toner inlet pipe 40*b*.

As shown in FIG. 4, the handle 40*c* is integrally formed on the left side of the container body 40*a*. The handle 40*c* is formed in a substantially L-shape in a side view. Specifically, the handle 40*c* extends from the upper end of the container body 40*a* toward the front in the horizontal direction, and then bends downward in the vertical direction to be connected to the lower part of the container body 40*a*. The user can grip the handle 40*c* by inserting fingers into the inner side of the L-shaped part of the handle 40*c*.

At the lower front corner on the left side of the container body 40*a*, a recess 40*d* is formed which is in a rectangular shape and open frontward and downward when viewed from the left side.

Specifically, the recess 40*d* includes a first vertical surface 40*g* extending along the front-rear direction, a second vertical surface 40*h* extending along the left-right direction, and a rectangular upper surface 40*i* connected to the upper edges of the vertical surfaces 40*g* and 40*h*. The first vertical surface 40*g* has an engaged recess 40*e* that receives an engaging hook 50*c* protruding from the opening/closing cover 50. In the present embodiment, the engaged recess 40*e* is formed in a hemispherical concave shape in the first vertical surface 40*g*.

Structure of Opening/Closing Cover

Figure 5:
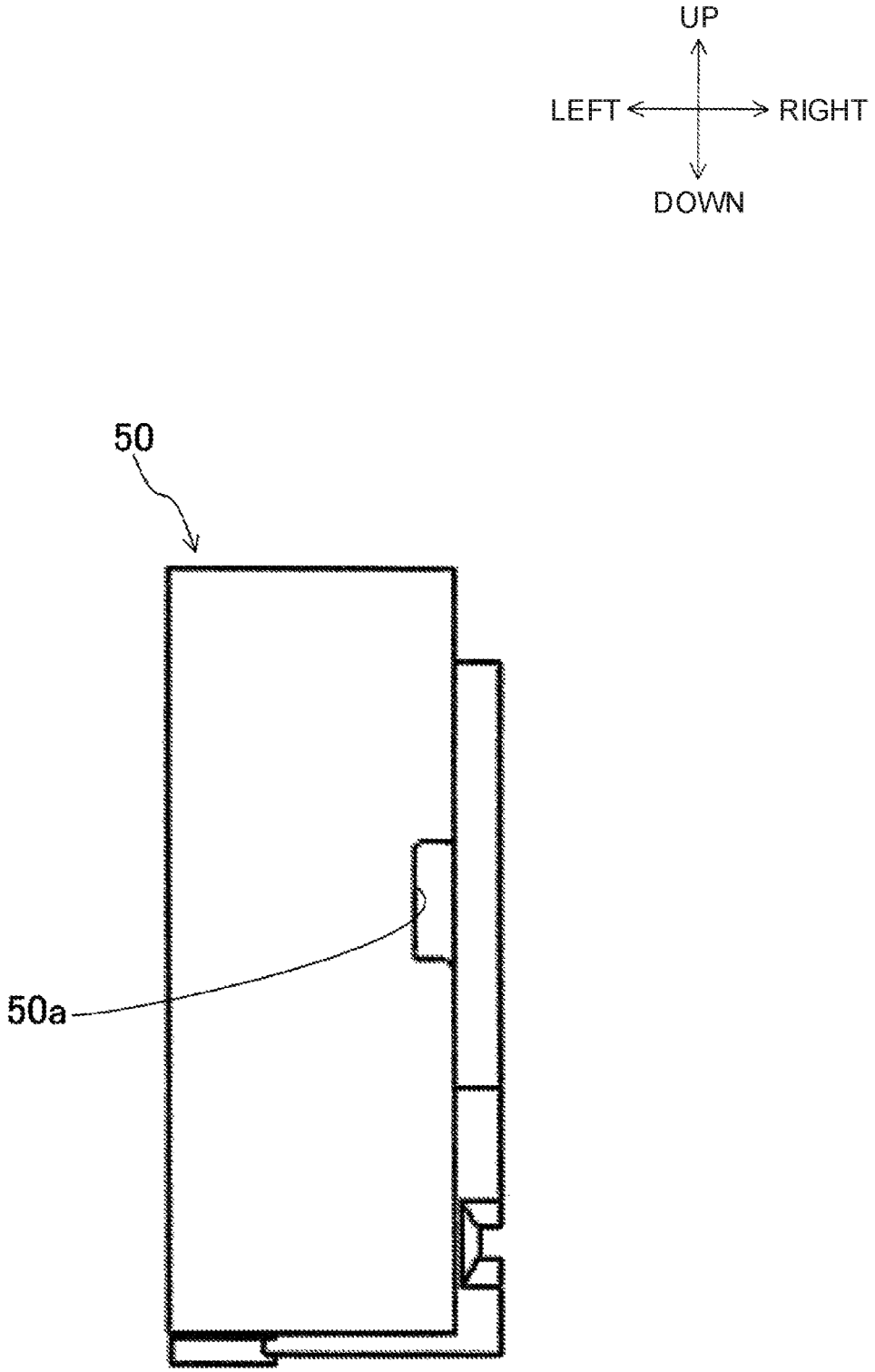
FIG. 5 is a front view of the opening/closing cover when viewed from the front side.

Next, the opening/closing cover 50 will be described with reference to FIGS. 5 to 7. FIG. 5 is a front view of a part of the apparatus body 2 where the opening/closing cover 50 in the closed position is attached, FIG. 6 is a front view when the opening/closing cover 50 is moved from the state of FIG. 5 to the open position, and FIG. 7 is a horizontal cross-sectional view (cross-section along line VII-VII of FIG. 2) when the opening/closing cover 50 is in the closed position.

The opening/closing cover 50 is made of plastic and constitutes a part of the outer surface of the apparatus body 2 when the opening 2*a* is closed. Specifically, the opening/closing cover 50 curves in a substantially L-shape in a plan view to connect the outer decorative cover 11*a* (see FIG. 2) of the sheet feed cassette 11 in the installed position to the left outer wall 29*a* which is a part of the resin cover 29 of the apparatus body 2 (see FIGS. 1 and 7). The outer surface of the opening/closing cover 50 extends continuously to the front side of the outer decorative cover 11*a* in the installed position when the opening/closing cover 50 is in the closed position. In the following description of the opening/closing cover 50, front, rear, left, and right respectively refer to the front, rear, left, and right directions of the opening/closing cover 50 in the closed position.

Figure 6:
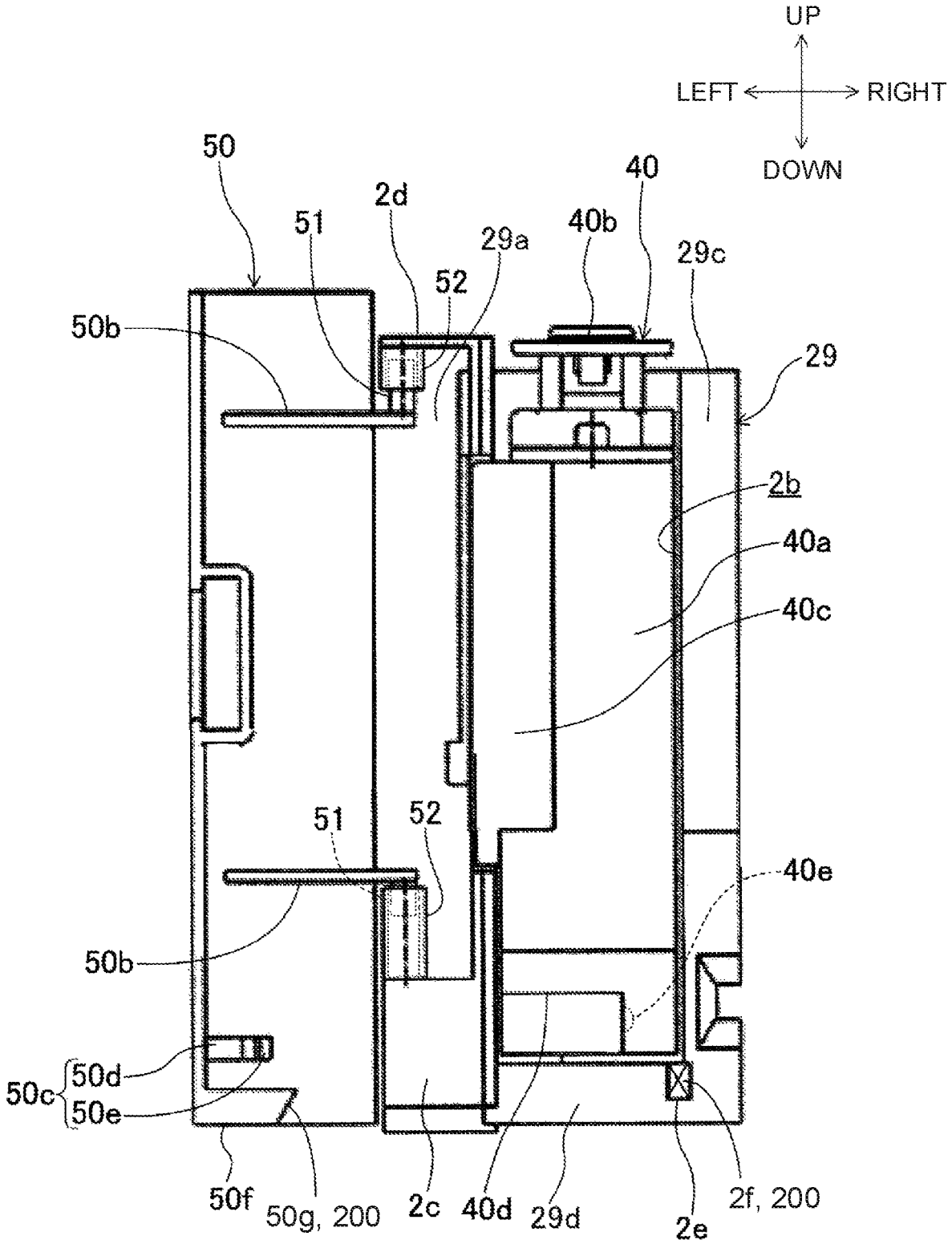
FIG. 6 is a front view of an installation space, when viewed from the front side, in which the waste toner container is installed while the opening/closing cover is in the open position.
Figure 7:
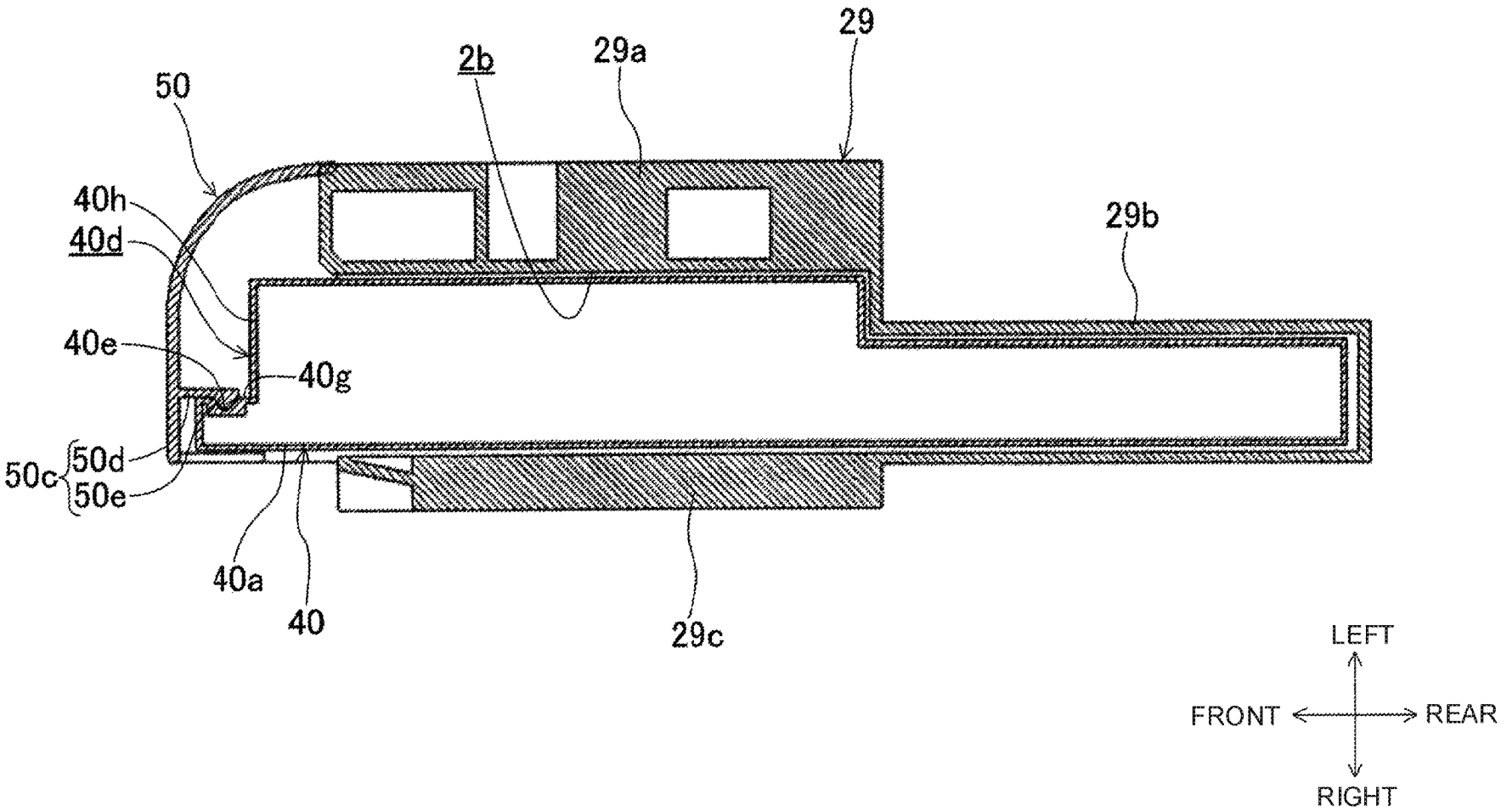
FIG. 7 is a cross-sectional view taken along line VII-VII of FIG. 2 when the waste toner container is installed.

As shown in FIG. 6, a pair of upper and lower pivotal axes 51 are disposed at the left edge of the opening/closing cover 50 in the closed position. The opening/closing cover 50 is pivotably attached to the left edge of the opening 2*a* via the pair of pivotal axes 51. The opening/closing cover 50 pivots about the axis line of the pair of pivotal axes 51 (an example of a specific axis line) and moves between a closed position to close the opening 2*a* and an open position at which the cover pivots outside (front side in the present embodiment) of the apparatus body from the closed position by a specific angle (specific maximum angle) around the axis line.

In the closed position, a gripping recess 50*a* (see FIG. 5) is formed at the right end of the opening/closing cover 50 from the front side to the rear side in which the user hooks fingers to open/close the opening/closing cover 50. Protruding on the back surface of the right end part of the opening/closing cover 50 in the closed position are an engaging hook 50*c* that engages with the engaged recess 40*e* of the waste toner container 40 and a cover-side guide piece 50*f* that guides the opening/closing cover 50 in the vertical direction to a specific position.

The engaging hook 50*c* is arranged at a position slightly above the lower end of the back surface of the opening/closing cover 50. The engaging hook 50*c* includes a flexible plate 50*d* and a claw 50*e*. The flexible plate 50*d* is connected perpendicularly to the back surface of the opening/closing cover 50 with its thickness extending in the horizontal direction. The flexible plate 50*d* can bend in the horizontal direction using the point of connection (a base end part) with the opening/closing cover 50 as the fulcrum. As shown in FIG. 7, the claw 50*e* protrudes in a hemispherical shape from the right side of the tip end of the flexible plate 50*d* when the opening/closing cover 50 is in the closed position. Then, the claw 50*e* engages with the engaged recess 40*e* of the waste toner container 40 when the opening/closing cover 50 is moved to the closed position.

The cover-side guide piece 50*f* is arranged so that the bottom surface of the cover-side guide piece 50*f* is flush with the bottom edge of the opening/closing cover 50. The cover-side guide piece 50*f* is located outside the engaging hook 50*c* in a plan view in terms of the radius of rotation of the cover. The cover-side guide piece 50*f* protrudes perpendicularly from the back surface of the opening/closing cover 50 with its tip end surface beveled as an inclined surface 50*g* of the cover-side guide piece 50*f*. The inclined surface 50*g* is beveled upward from the front side toward the rear side when the opening/closing cover 50 is in the closed position. For example, a bevel angle is set to 55 to 60 degrees in the present embodiment, but other angle ranges may be used. The inclined surface 50*g* of the cover-side guide piece 50*f* abuts in a wedge-shaped manner on the inclined surface 2*f* of the body-side guide piece 2*e*, which will be described later, formed on the apparatus body 2 when the opening/closing cover 50 is moved to the closed position (see FIG. 9). The inclined surface 50*g* of the cover-side guide piece 50*f* acts as the cover-side inclined surface, and the inclined surface 2*f* of the body-side guide piece 2*e* acts as to the body-side inclined surface.

As shown in FIG. 6, a pair of horizontal ribs 50*b* are also formed at an interval in the vertical direction to protrude from the back surface of the opening/closing cover 50. The pivotal axes 51 stand respectively at the ends of the pair of horizontal ribs 50*b*. Each of the pair of pivotal axes 51 is fitted in a pair of support tubes 52 disposed at an interval in the vertical direction. The lower support tube 52 protrudes from the upper surface of a support base 2*c* formed on the left outer wall 29*a* of the apparatus body 2. The upper support tube 52 protrudes from the lower surface of a support plate 2*d* formed on the left outer wall 29*a*.

The pair of pivotal axes 51 is supported in the support tubes 52 to pivot about their axial lines and slide along the axial (vertical) direction. When the pair of pivotal axes 51 slides in the vertical direction, the opening/closing cover 50 can move between specific upper and lower positions. In the closed position, the opening/closing cover 50 is located at the specific lower position. At the lower position, the lower horizontal rib 50*b* on the back surface of the opening/closing cover 50 abuts on the upper surface of the lower support tube 52 (see FIG. 6).

The left outer wall 29*a* is a part of the resin cover 29. As shown in FIGS. 6 and 7, the resin cover 29 includes the left outer wall 29*a*, an interior wall 29*c*, a U-shaped wall 29*b*, and a bottom wall 29*d*. The interior wall 29*c* is disposed on the right-hand side of and spaced apart from the left outer wall 29*a*. The U-shaped wall 29*b* is shaped like the letter U that opens frontward in a plan view and connects the rear end of the left outer wall 29*a* with the rear end of the interior wall 29*c*. The left outer wall 29*a*, the interior wall 29*c*, and the U-shaped wall 29*b* constitute an installation space 2*b* for the waste toner container 40. The bottom wall 29*d* has a rectangular plate shape extending in the front-rear direction, and forms a loading platform for the waste toner container 40 to be loaded in the installation space 2*b*.

As shown in FIG. 6, the body-side guide piece 2*e* protrudes from near the bottom part of the interior wall 29*c* on the front end surface of the bottom wall 29*d*. The body-side guide piece 2*e* abuts on the cover-side guide piece 50*f* formed on the opening/closing cover 50 when the opening/closing cover 50 is moved to the closed position, and guides the engaging hook 50*c* of the opening/closing cover 50 toward the engaged recess 40*e* of the waste toner container 40.

Figure 8:
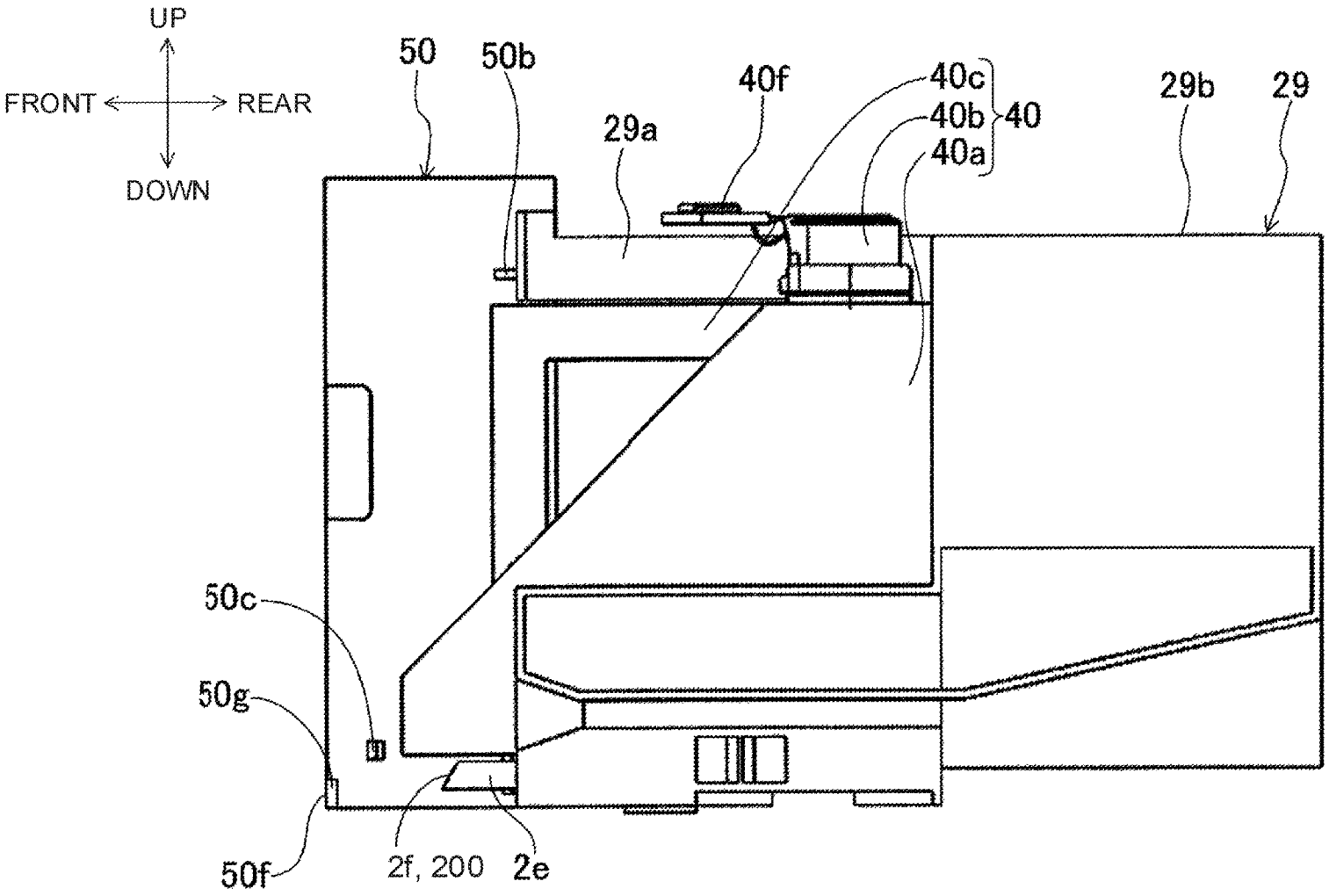
FIG. 8 is a side view of a part of the apparatus body where the waste toner container is installed in the open position of the opening/closing cover when viewed from the right side.
Figure 9:
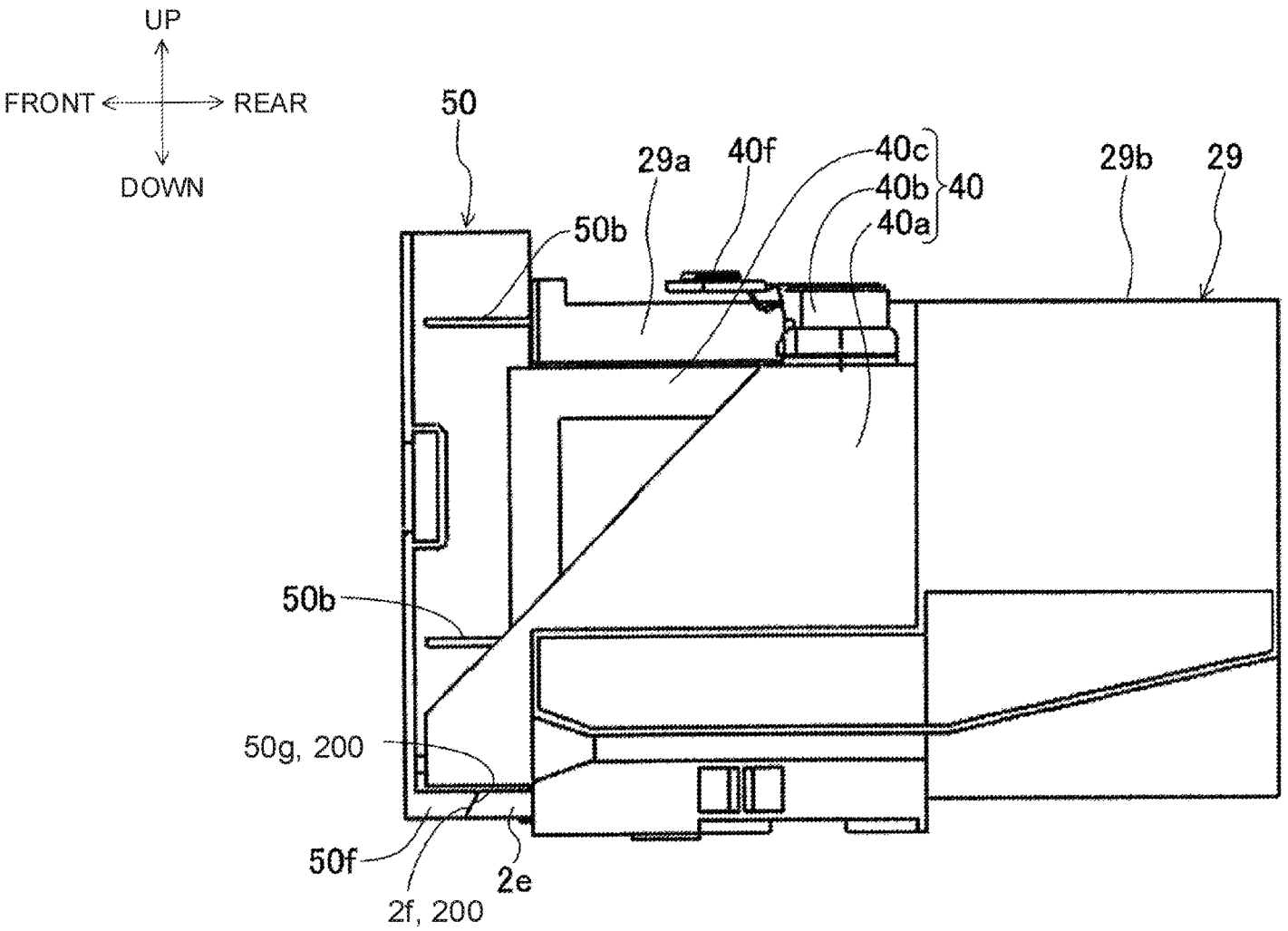
FIG. 9 is a side view of the part of the apparatus body where the waste toner container is installed in the closed position of the opening/closing cover when viewed from the right side.

Specifically, the body-side guide piece 2*e* is in a pillar shape having a rectangular cross-section extending in the front-rear direction, and its protruding side (front side) is beveled as the inclined surface 2*f*. As shown in FIGS. 8 and 9, the inclined surface 2*f* is inclined downward and frontward.

A bevel angle of the inclined surface 2*f* is equal to the bevel angle of the inclined surface 50*g* of the cover-side guide piece 50*f*. In the engagement state where the inclined surface 50*g* of the cover-side guide piece 50*f* abuts on the inclined surface 2*f* of the body-side guide piece 2*e* (i.e., the opening/closing cover 50 is in the closed position), the cover-side guide piece 50*f* and the body-side guide piece 2*e* engage seamlessly in the front-rear direction.

The position of the lower end of the inclined surface 2*f* is located lower than the position of the upper end of the inclined surface 50*g* of the cover-side guide piece 50*f* in the open position of the opening/closing cover 50 (i.e., when the opening/closing cover 50 is located at the lowest position, see FIG. 8). This causes the inclined surface 50*g* of the cover-side guide piece 50*f* to abut on the inclined surface 2*f* of the body-side guide piece 2*e* without fail in the course of shifting the opening/closing cover 50 to the closed position.

With reference to FIGS. 8 and 9, the transition process of the opening/closing cover 50 from the open position to the closed position when the waste toner container 40 is installed in the installation space 2*b* will be specifically described.

FIG. 8 is a side view seen from the right side showing a state in which the opening/closing cover 50 is in the open position with the waste toner container 40 installed in the installation space 2*b*. In this state, the engaging hook 50*c* is apart from the engaged recess 40*e* of the waste toner container 40 and protrudes from the back surface of the opening/closing cover 50 toward the right side (the front side perpendicular to the sheet surface of FIG. 8). The cover-side guide piece 50*f* is located at a distance from the body-side guide piece 2*e* and protrudes toward the right side from the back surface of the opening/closing cover 50.

As the opening/closing cover 50 pivots to the right side (the front side perpendicular to the sheet surface of FIG. 8) from the state shown in FIG. 8, the inclined surface 50*g* of the cover-side guide piece 50*f* abuts on the inclined surface 2*f* of the body-side guide piece 2*e*. As the opening/closing cover 50 pivots further, the inclined surface 50*g* of the cover-side guide piece 50*f* moves backward and diagonally upward along the inclined surface 2*f* of the body-side guide piece 2*e* (see FIG. 9). Along with this, the engaging hook 50*c* (see FIG. 7) of the opening/closing cover 50 is guided toward the engaged recess 40*e* of the waste toner container 40. When the opening/closing cover 50 reaches the closed position, the claw 50*e* of the engaging hook 50*c* engages with the engaged recess 40*e* of the waste toner container 40. As a result, the opening/closing cover 50 is held in the closed position.

Thus, the opening/closing cover 50 can be held in the closed position by the claw 50*e* engaging with the engaged recess 40*e* when the waste toner container 40 is installed in the installation space 2*b*. Without the waste toner container 40 installed in the installation space 2*b*, the opening/closing cover 50 cannot be held in the closed position and is returned to the open side when the opening/closing cover 50 is moved to the closed position.

Figure 10A:
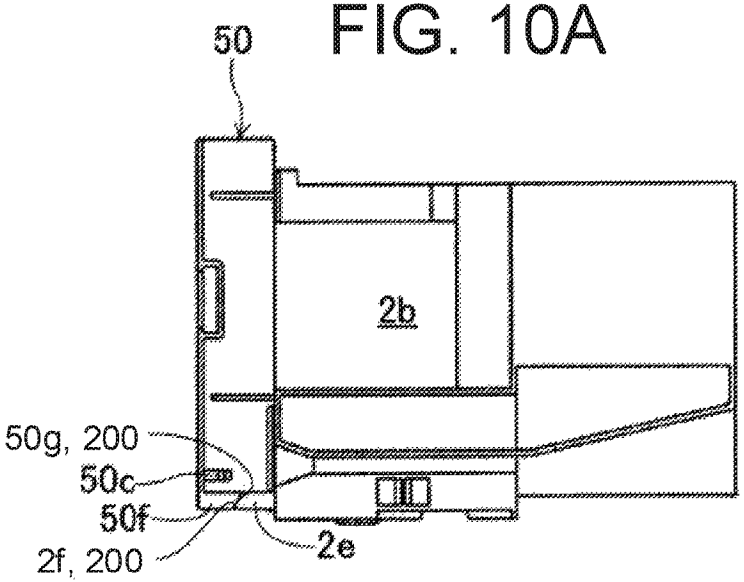
FIGS. 10A to 10D are explanatory views for explaining the operation of an inclined surface of the opening/closing cover and an inclined surface of the apparatus body which act as an opening drive section.
Figure 10B:
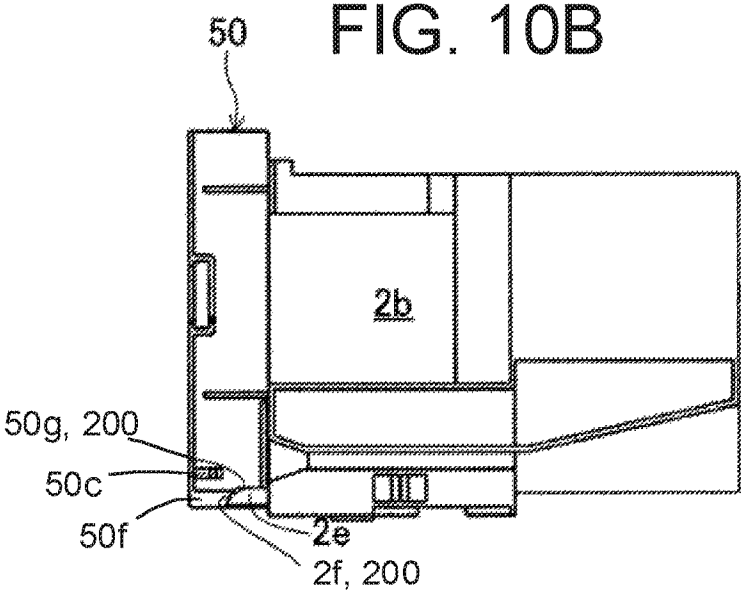
Figure 10C:
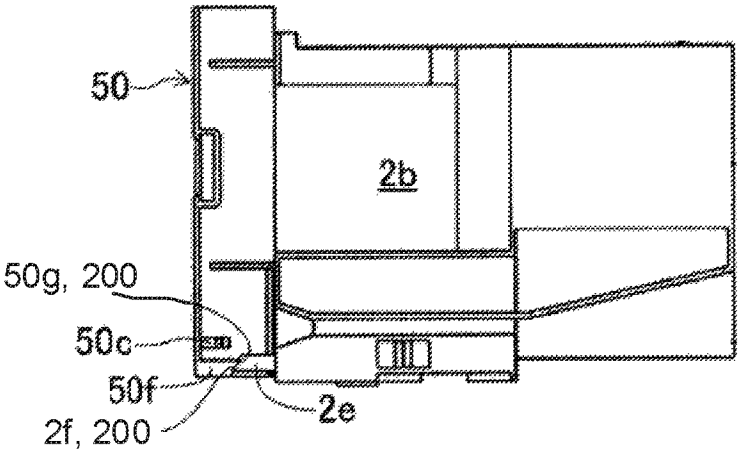
Figure 10D:
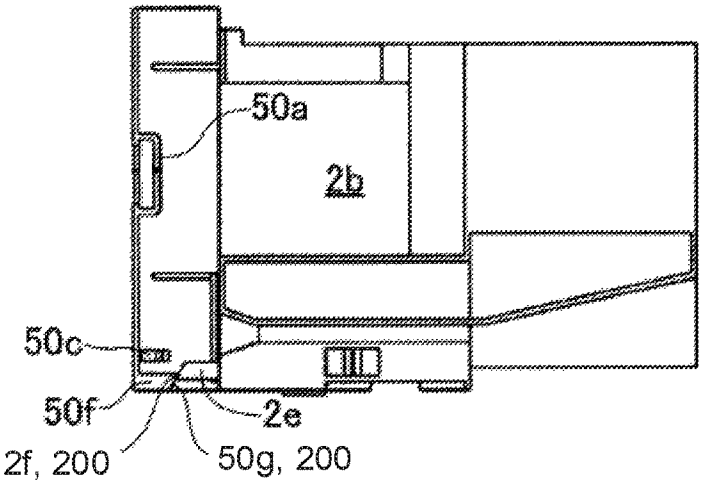

Specifically, as shown in FIG. 10A, when the opening/closing cover 50 is in the closed position without the waste toner container 40 installed in the installation space 2*b*, the opening/closing cover 50 is not constrained to the closed position and remains free because there is no counterpart engaged part to engage with the engaging hook 50*c* of the opening/closing cover 50. Accordingly, the inclined surface 50*g* of the cover-side guide piece 50*f* slides downward along the inclined surface 2*f* of the body-side guide piece 2*e* due to the weight of the opening/closing cover 50. FIG. 10B to FIG. 10D are schematic views showing the sliding down process in chronological order. The opening/closing cover 50 pivots toward the open side using the pivotal axis 51 as the fulcrum while the inclined surface 50*g* of the cover-side guide piece 50*f* moves forward and diagonally downward along the inclined surface 2*f* of the body-side guide piece 2*e*. A final opening amount of the opening/closing cover 50 is determined by the size of the sliding resistance between the pivotal axis 51 and the support tube 52, but it should be large enough to allow a person (user) to visibly recognize that the opening/closing cover 50 is open. Thus, the inclined surface 50*g* of the cover-side guide piece 50*f* and the inclined surface 2*f* of the body-side guide piece 2*e* function as an opening drive section 200.

Operation and Effect of the Embodiment

As described above, the waste toner container 40 has the engaged recess 40*e* in the image forming apparatus 1 of the present embodiment. The opening/closing cover 50 has the engaging hook 50*c* that can engage with the engaged recess 40*e*. In the closed position, the engaging hook 50*c* engages with the engaged recess 40*e* of the waste toner container 40 to hold the opening/closing cover 50 when the waste toner container 40 is installed in the apparatus body 2.

This structure allows the engaging hook 50*c* to engage with the engaged recess 40*e* of the waste toner container 40 upon closure of the opening/closing cover 50 when the waste toner container 40 is installed in the apparatus body 2. In the course of engagement, an engaging sound is generated or an engaging feeling is transmitted to the hand of the user. By hearing the engaging sound or obtaining the engaging feeling, the user can recognize that the waste toner container 40 is installed in the apparatus body 2. Without the waste toner container 40 installed in the apparatus body 2, the user hears no engaging sound nor engaging feeling in hand when the opening/closing cover 50 is closed, thus recognizing that no waste toner container 40 is installed in the apparatus body 2.

Further, the image forming apparatus 1 of the present embodiment includes the opening drive section 200 interposed between the opening/closing cover 50 and the apparatus body 2 and driving the opening/closing cover 50 toward the open position when the opening/closing cover 50 is moved to the closed position without the waste toner container 40 installed in the apparatus body 2.

Specifically, the opening drive section 200 includes the inclined surface 50*g* (see FIG. 9) formed on the opening/closing cover 50 and inclining upward toward the apparatus body 2 from the opening/closing cover 50 in the horizontal direction when the opening/closing cover 50 is in the closed position, and the inclined surface 2*f* formed on the apparatus body 2 and abutting on the opposing inclined surface 50*g* when the opening/closing cover 50 is in the closed position.

When the opening/closing cover 50 is moved to the closed position without the waste toner container 40 installed in the apparatus body 2, the inclined surface 50*g* of the opening/closing cover 50 slides down diagonally due to the weight of the opening/closing cover 50 along the inclined surface 2*f* of the apparatus body 2, causing the opening drive section 200 to drive the opening/closing cover 50 toward the open position.

Thus, the opening/closing cover 50 is not held in the closed position but opens immediately by the action of the opening drive section 200 when the opening/closing cover 50 is closed without the waste toner container 40 installed in the apparatus body 2. When observing the open state of the opening/closing cover 50, the user can notice that the waste toner container 40 has not been installed.

In a case where the user operates the image forming apparatus 1 via, for example, LAN connection from a remote terminal device away from the image forming apparatus 1, instead of directly operating the operation panel 100 of the image forming apparatus 1, the user cannot visibly recognize the error message displayed on the display unit 101 of the image forming apparatus 1. But the user can notice that the waste toner container 40 is not installed by observing the open state of the opening/closing cover 50.

Further, in the present embodiment, the inclined surface 50*g* of the opening/closing cover 50 is in sliding contact with the inclined surface 2*f* of the apparatus body 2 in the course of moving the opening/closing cover 50 from the open position to the closed position and then moves diagonally upward along the inclined surface 2*f* to guide the engaging hook 50*c* of the opening/closing cover 50 toward the engaged recess 40*e* of the waste toner container 40.

This structure enables a secured engagement of the engaging hook 50*c* with the engaged recess 40*e* of the waste toner container 40 in the course of closing the opening/closing cover 50. Further, in the present embodiment, the outer surface of the opening/closing cover 50 extends continuously to the front side in the drawing direction of the sheet feed cassette 11, when the sheet feed cassette 11 is installed, to constitute a part of the outer surface of the apparatus body 2 when the opening/closing cover 50 is in the closed position. The continuity between the opening/closing cover 50 and the outer surface of the apparatus body 2 should be impaired if the opening/closing cover 50 is driven to open only slightly from the closed position, so that the user can easily notice the opening of the opening/closing cover 50. Thus, by observing the opening of the opening/closing cover 50, the user can easily notice that the waste toner container 40 is not installed.

Modification

Figure 11:
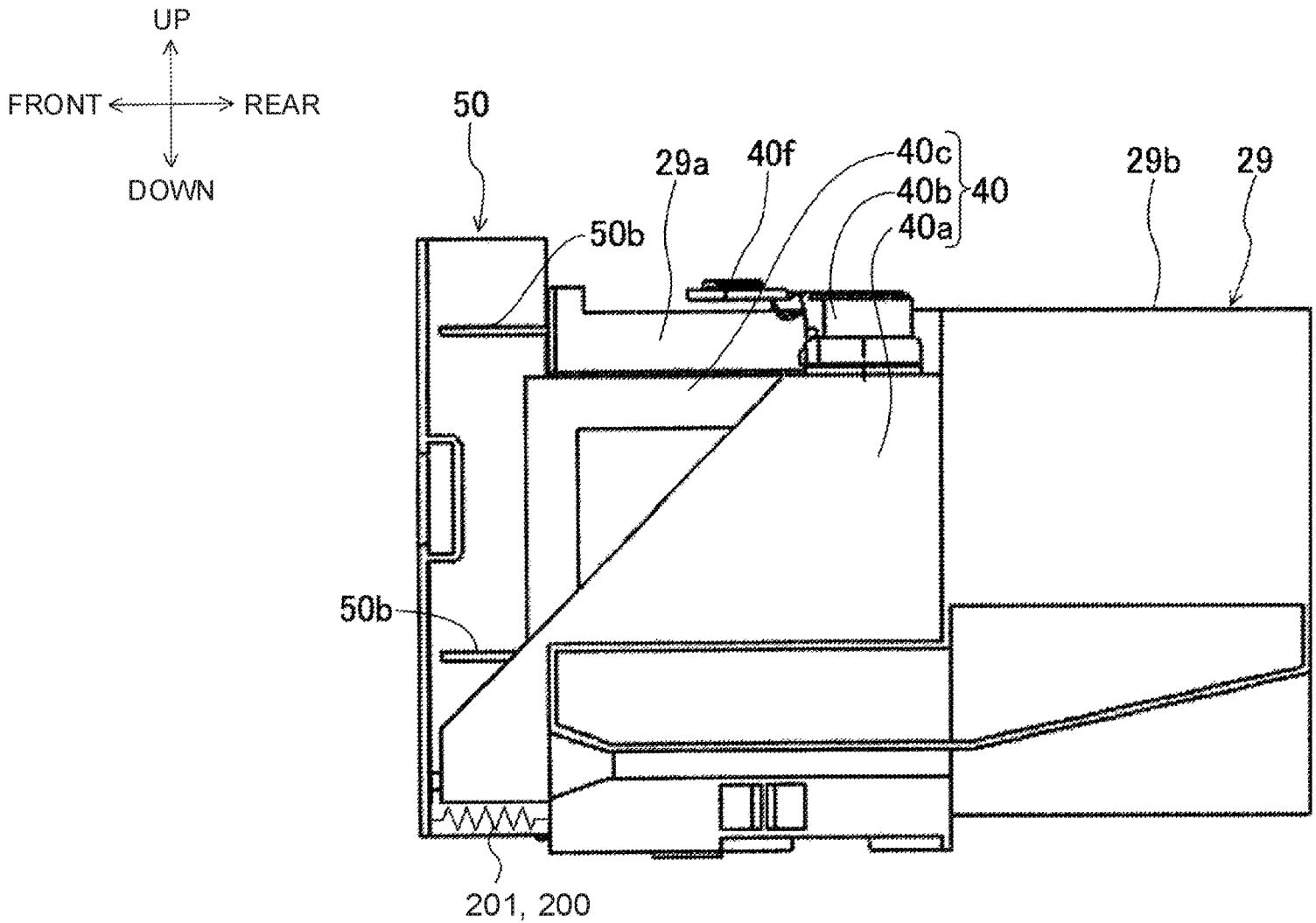
FIG. 11 shows a modification corresponding to FIG. 9.

FIG. 11 is a view showing a modification of the above-described embodiment corresponding to FIG. 9. In this modification, the structure of the opening drive section 200 differs from the above-described embodiment. The same components as those in FIG. 9 are designated by the same reference numerals, and detailed description thereof will be omitted.

Specifically, the opening drive section 200 of the modification includes a compression coil spring 201 (an example of an urging spring) interposed between the apparatus body 2 and the opening/closing cover 50 to urge the opening/closing cover 50 to the open side when the opening/closing cover 50 is in the closed position. The compression coil spring 201 can be fixed to the opening/closing cover 50 or to the apparatus body 2.

This structure allows the opening/closing cover 50 to be driven reliably to the open side with an even stronger force than in the case of driving the opening/closing cover 50 to the open side using the sliding force of the inclined surface 50*g* of the cover-side guide piece 50*f* along the inclined surface 2*f* of the body-side guide piece 2*e*. As a result, the opening amount of the opening/closing cover 50 by the opening drive section 200 can increase. This enables the user located away from the image forming apparatus 1 to notice without fail that the opening/closing cover 50 is open and that the waste toner container 40 is not installed.

Although the compression coil spring is used as the urging spring in the present modification, other springs such as a torsion spring may be attached around the pivotal axis 51 of the opening/closing cover 50. In this case, the urging spring does not protrude from the apparatus body 2 or the opening/closing cover 50, so that the waste toner container 40 can be installed and removed with no disturbance by the urging spring.

Other Modifications

In the above-described embodiment and modification, the opening/closing cover 50 opens and closes the opening 2*a* by pivoting about the axis line extending in the vertical direction (an example of the specific direction). Alternatively, the opening/closing cover 50 may open and close the opening 2*a* by, for example, pivoting about an axis line extending in the horizontal direction.

Although the above-described embodiment and modifications have been described with the printer as an example of the image forming apparatus 1, the image forming apparatus 1 may be a copier, a multifunctional printer (MFP), or a facsimile machine.

The present disclosure includes any combinations of the embodiment and modifications.

As described above, the present disclosure is useful for image forming apparatuses especially when applied to printers, facsimiles, copiers, or MFPs.

What is claimed is:

1. An image forming apparatus, comprising:

a waste toner container installed removably in an apparatus body through an opening and collecting a waste toner discharged from an image forming section in which an image is formed with toner; and an opening/closing cover supported at an edge of the opening and pivoting about an axis line extending in a specific direction, the opening/closing cover pivoting about the axis line and movable between a closed position to close the opening and an open position to open the opening, wherein the waste toner container has an engaged part, the opening/closing cover has an engaging part that engages with the engaged part, and the engaging part engages with the engaged part in the closed position to hold the opening/closing cover in the closed position when the waste toner container is installed in the apparatus body.

2. The image forming apparatus according to claim 1, further comprising:

an opening drive section interposed between the opening/closing cover and the apparatus body and driving the opening/closing cover toward the open position when the opening/closing cover is moved to the closed position without the waste toner container installed in the apparatus body.

3. The image forming apparatus according to claim 2, wherein the axis line extends in the vertical direction, the opening/closing cover is supported at the edge to be movable in the vertical direction along the axis line in a manner that the opening/closing cover is located at a specific upper position at the closed position and at a specific lower position at the open position, the opening drive section includes a cover-side inclined surface formed on the opening/closing cover and inclined upward from the opening/closing cover in the horizontal direction toward the apparatus body when the opening/closing cover is in the closed position, and a body-side inclined surface formed on the apparatus body and abutting on the opposing cover-side inclined surface when the opening/closing cover is in the closed position, and when the opening/closing cover moves to the closed position without the waste toner container installed in the apparatus body, the cover-side inclined surface slides diagonally downward along the body-side inclined surface due to the weight of the opening/closing cover, causing the opening drive section to drive the opening/closing cover toward the open position.

4. The image forming apparatus according to claim 3, wherein the cover-side inclined surface guides the engaging part of the opening/closing cover toward the engaged part of the waste toner container installed in the apparatus body by moving upward along and in sliding contact with the body-side inclined surface in the course of moving the opening/closing cover from the open position to the closed position.

5. The image forming apparatus according to claim 2, wherein the opening drive section includes an urging spring that urges the opening/closing cover toward the open position while the opening/closing cover is in the closed position.

6. The image forming apparatus according to claim 1, comprising:

a sheet feed cassette that accommodates a sheet to be fed to the image forming section, wherein the sheet feed cassette is drawable to an outside of the apparatus body from an installation position at which the sheet is allowed to be fed to the image forming section, and an outer surface of the opening/closing cover extends continuously to a front side in the drawing direction of the sheet feed cassette, when the sheet feed cassette is installed, to constitute a part of an outer surface of the apparatus body when the opening/closing cover is in the closed position.

* * * * *